US010587961B2

(12) United States Patent
Rombach

(10) Patent No.: US 10,587,961 B2
(45) Date of Patent: Mar. 10, 2020

(54) TRANSDUCER ELEMENT AND MEMS MICROPHONE

(71) Applicant: Epcos AG, München (DE)

(72) Inventor: Pirmin Hermann Otto Rombach, Kongens Lyngby (DK)

(73) Assignee: TDK Corporation, Tokyo (JP)

( * ) Notice: Subject to any disclaimer, the term of this patent is extended or adjusted under 35 U.S.C. 154(b) by 175 days.

(21) Appl. No.: 15/319,890

(22) PCT Filed: Jun. 12, 2015

(86) PCT No.: PCT/EP2015/063206
§ 371 (c)(1),
(2) Date: Dec. 19, 2016

(87) PCT Pub. No.: WO2015/197382
PCT Pub. Date: Dec. 30, 2015

(65) Prior Publication Data

US 2017/0127188 A1 May 4, 2017

(30) Foreign Application Priority Data

Jun. 26, 2014 (DE) ..... 10 2014 108 984

(51) Int. Cl.
*H04R 19/00* (2006.01)
*H04R 19/04* (2006.01)
*H04R 7/18* (2006.01)

(52) U.S. Cl.
CPC ..... *H04R 19/04* (2013.01); *H04R 7/18* (2013.01); *H04R 2201/003* (2013.01); *H04R 2307/204* (2013.01); *H04R 2307/207* (2013.01)

(58) Field of Classification Search
CPC ..... H04R 19/005; H04R 2201/003
See application file for complete search history.

(56) References Cited

U.S. PATENT DOCUMENTS 5,870,482 A 2/1999 Loeppert et al.
7,885,423 B2 2/2011 Weigold
8,422,703 B2 4/2013 Weigold
8,921,957 B1 * 12/2014 Zhang ..... H04R 1/04 257/416

(Continued)

FOREIGN PATENT DOCUMENTS

DE 69325732 T2 4/2000
DE 10030352 A1 1/2002

(Continued)

OTHER PUBLICATIONS

International Search Report corresponding to Application No. PCT/EP2015/063206, European Patent Office, dated Sep. 8, 2015; (2 pages).

(Continued)

*Primary Examiner* — Matthew A Eason
(74) *Attorney, Agent, or Firm* — Nixon Peabody LLP

(57) ABSTRACT

The present application relates to a transducer element (1) which comprises: a movable diaphragm (2, 2*a*, 2*b*) which has a border (4), a frame (5) to which the border (4) of the diaphragm (2, 2*a*, 2*b*) is attached, and a reinforcement element (10) which connects to one another a first sub-section of the frame (5) and a second sub-section of the frame (5) which lies opposite the first sub-section.

19 Claims, 5 Drawing Sheets

(56) References Cited

U.S. PATENT DOCUMENTS

Figure 1:
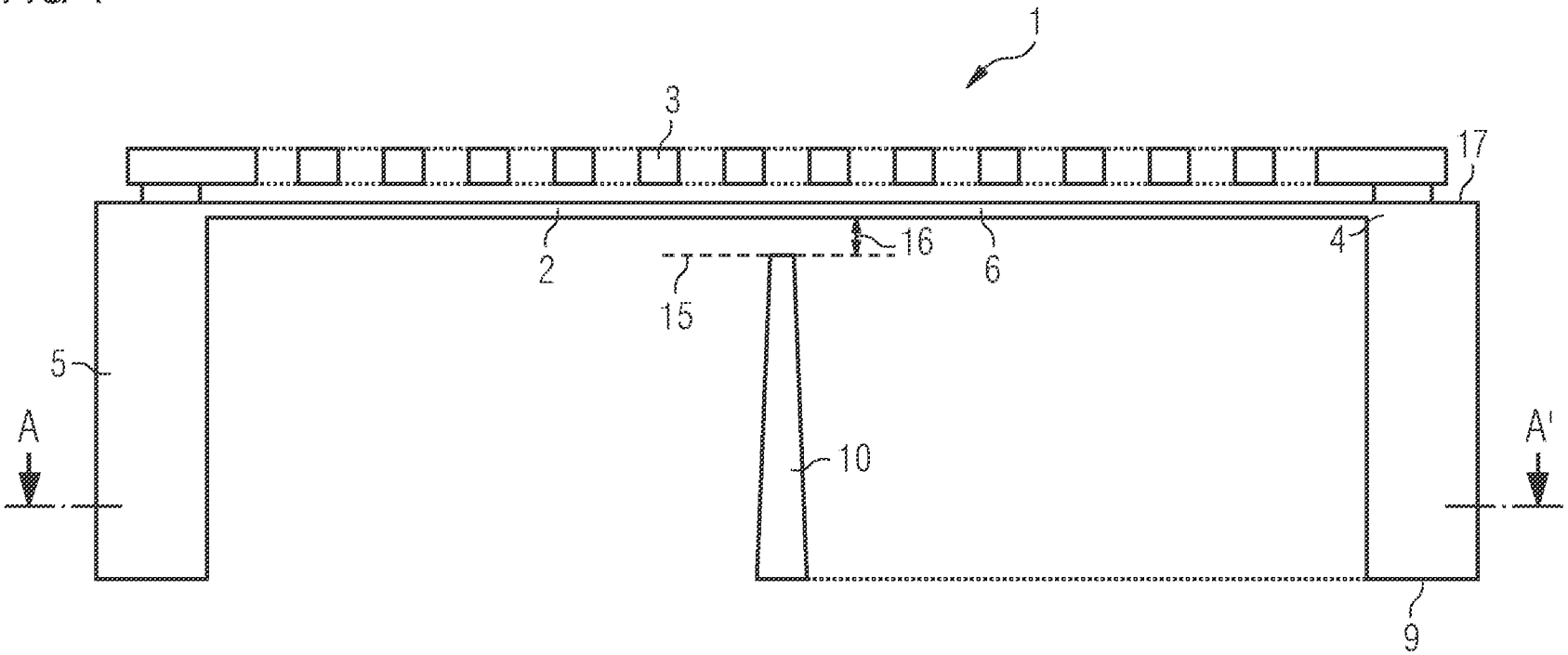

| | | | | |
|---|---|---|---|---|
| 9,319,798 | B2 * | 4/2016 | Okugawa | H04R 19/005 |
| 2009/0208037 | A1 * | 8/2009 | Zhe | H04R 7/20 381/174 |
| 2011/0261979 | A1 * | 10/2011 | Yang | H04R 7/18 381/174 |
| 2014/0353780 | A1 * | 12/2014 | Perletti | B81B 3/0021 257/416 |
| 2015/0071467 | A1 * | 3/2015 | Kaplan | H04R 17/00 381/190 |

FOREIGN PATENT DOCUMENTS

| | | | |
|---|---|---|---|
| DE | 102005042664 | A1 | 3/2007 |
| DE | 102007020847 | A1 | 11/2008 |
| DE | 102008001185 | A1 | 10/2009 |
| EP | 0707781 | B1 | 4/1999 |
| EP | 0561566 | B1 | 7/1999 |
| EP | 2860990 | A1 | 4/2015 |
| GB | 2086694 | A | 5/1982 |
| JP | 55-130500 | | 3/1979 |
| JP | 56-93098 | | 12/1979 |
| JP | 62-34899 | | 2/1987 |
| WO | WO 2007/004665 | A1 | 1/2007 |

OTHER PUBLICATIONS

Chen, J. et al.: "On the single-chip condenser miniature microphone using DRIE and backside etching techniques" Sensors and Actuators A: Physical 103.1, 2003 pp. 42-47.

* cited by examiner

TRANSDUCER ELEMENT AND MEMS MICROPHONE

CROSS-REFERENCE TO RELATED APPLICATIONS

This application is a U.S. National Stage of International Application No. PCT/EP2015/063206, filed Jun. 12, 2015, which claims the benefit of Germany Patent Application No. 10 2014 108 984.7, filed on Jun. 26, 2014, both of which are incorporated herein by reference in their entireties.

The present invention relates to a transducer element. This can be, in particular, a transducer element which is configured to convert acoustic signals or other pressure fluctuations into electrical signals. Such a transducer element is used, in particular, in condenser microphones.

For a condenser microphone it is decisive that the transducer element is miniaturized as well as possible and at the same time can ensure a high reception quality in this context. Microphones with large diaphragms typically have a better signal-to-noise ratio and therefore permit a better recording quality. Since, therefore, the diaphragm surface cannot be reduced to any desired degree, a further miniaturization is possible only if the space which is occupied by a frame to which the diaphragm is attached can be reduced.

However, if the frame is configured to be increasingly thin, mechanical stability problems occur. In particular, a fixed back plate which is attached to the frame can apply forces to the frame which, in the case of an excessively thin frame, bring about bending of the frame. In addition, the frame transmits these forces to the diaphragm, with the result that the measuring accuracy of the diaphragm is disrupted by the forces which occur. In particular in the case of asymmetrical diaphragms, for example in the case of elliptical, non-circular diaphragms and in the case of rectangular, non-square diaphragms, the mechanical stresses which are generated thus lead to significant worsening of the measuring accuracy of the diaphragm, e.g. when there is a large change in temperature.

The object of the present invention is therefore to permit miniaturization of the transducer element without worsening the measuring properties of the diaphragm.

This object is achieved by means of a transducer element according to the present claim 1.

A transducer element which comprises a movable diaphragm which has a border, a frame to which the border of the diaphragm is attached, and a reinforcement element which connects to one another a first sub-section of the frame and a second sub-section of the frame which lies opposite the first sub-section.

The reinforcement element can, in particular, be connected mechanically directly to the first sub-section of the frame and directly to the second sub-section of the frame. The reinforcement element can be configured, in particular, to hold the first sub-section of the frame and the second sub-section of the frame at a fixed distance from one another. Correspondingly, the reinforcement element prevents forces which act on the frame from being able to move to too great an extent the first sub-section of the frame relative to the second sub-section of the frame.

The reinforcement element can have a height which corresponds to the height of the frame minus a minimum distance between the reinforcement element and the movable diaphragm. Correspondingly, the reinforcement element can ensure that the first sub-section and the second sub-section of the frame are at the same distance from one another along the entire height of the reinforcement element.

This can prevent, in particular, the first and second sub-sections from deforming along their respective height and, for example, on the lower edge of the frame located on the side pointing away from the diaphragm, from being at a larger distance from one another than near to the upper edge of the frame to which the diaphragm is attached.

The reinforcement element can in this way ensure that fewer forces are applied to the movable diaphragm by the frame. In particular, the reinforcement element can reduce the portion of the asymmetrical forces which the frame applies to the movable diaphragm.

This is important, in particular in the case of an asymmetrical stress distribution which can occur, in particular, in the case of a non-square or a non-circular diaphragm. In particular in the case of this type of diaphragm, the reinforcement element therefore brings about decisive improvements in the recording quality, which would otherwise be possible only if the frame were configured to be significantly thicker. However, even in the case of symmetrical diaphragms, for instance circular or square diaphragms, the reinforcement element can bring about improvements which permit a further reduction in the wall thickness of the frame.

Overall, the reinforcement element permits the wall thickness of the frame to be reduced and therefore the transducer element to be miniaturized further without the measuring accuracy of the transducer element being worsened in this context.

The frame can be composed, for example, from silicon. Both the movable diaphragm and a fixed back plate can be arranged on an upper edge of the frame, wherein the fixed back plate is attached at a short distance from the diaphragm. The border of the diaphragm can, in particular, be attached to the frame in such a way that the border of the diaphragm cannot move in the direction of a surface normal of the diaphragm.

The first and second sub-sections of the frame extend essentially from a lower edge of the frame, which is arranged on the side pointing away from the diaphragm, as far as a height which corresponds to the height of the frame minus a minimum distance between the reinforcement element and the diaphragm. The sub-sections can be embodied, for example, in the shape of a wedge or in the shape of a strip. The first and second sub-sections are not directly adjacent to one another. Instead there are further sub-sections between the first and second sub-sections.

The term "lies opposite" is to be understood here as meaning that the first and second subsections are not directly adjacent to one another. A connecting line which connects any point on the first sub-section to any point on the second sub-section runs through the interior of the transducer element without intersecting the frame in the process.

The transducer element can be configured to convert acoustic signals or other pressure fluctuations into electrical signals. In particular, the transducer element can be configured to convert sound signals into electrical signals. The transducer element can be an MEMS element (MEMS=micro-electromechanical system).

The reinforcement element can have a height which is less than a height of the frame. Correspondingly, the reinforcement element can be spaced apart from the movable diaphragm by a minimum distance. In this way, it is ensured that the diaphragm does not rest on the reinforcement element, with the result that the reinforcement element cannot disrupt the movements of the diaphragm. The minimum distance is selected, in particular, in such a way that even in the case of deflections of the diaphragm, the latter does not enter into direct mechanical contact with the reinforcement element.

The reinforcement element and the frame can be composed of the same material. This material can be, in particular, silicon. In particular, the reinforcement element and the frame can be manufactured in a common method step, for example in an etching process. Correspondingly, no additional method step is necessary for the fabrication of the reinforcement element. Only an etching mask which is used for fabricating the frame has to be correspondingly adapted so that the etching mask forms the reinforcement element too. The reinforcement element can therefore be fabricated with minimum expenditure.

In addition, the reinforcement element can connect to one another a third sub-section of the frame and a fourth sub-section of the frame which lies opposite the third sub-section. The reinforcement element can hold the third and the fourth sections at a fixed distance from one another. In particular, the third and fourth sections are held at a fixed distance from one another along the entire height of the reinforcement element. The third and the fourth sub-sections are also held securely by the reinforcement element in a fixedly defined position with respect to the first and second sub-sections.

A reinforcement element which is configured in this way can reduce even further the forces which occur and which act on the diaphragm. Depending on the selected shape of the diaphragm, the frame can have more than one mechanical weak point. A second mechanical weak point of the frame could be eliminated by the connection of the third and fourth sub-sections. In particular, none of the first to fourth sub-sections of the frame can be directly adjacent to any other of the first to fourth sub-sections of the frame.

The reinforcement element can be in the shape of a strip. In particular, the reinforcement element can be embodied in the shape of a strip in a cross-section through the transducer element, in a plane parallel to the diaphragm. The reinforcement element can be in the shape of a strip over its entire height.

In alternative refinements, the reinforcement element can be in the shape of a cross or in the shape of a star. This information also relates to a cross section through the transducer element in a plane parallel to the diaphragm. Depending on the form of the diaphragm and of the associated frame, a reinforcement element which is in the shape of a strip, in the shape of a cross or in the shape of a star may be advantageous. The reinforcement element should always be selected such that it can compensate mechanical weak points of the frame.

The diaphragm can be elliptical or rectangular. In particular, the diaphragm can have an asymmetrical design and can have, for example, the shape of a non-circular ellipse or of a non-square rectangle. In particular in the case of such diaphragms which have a certain degree of asymmetry, the use of the reinforcement element is particularly advantageous, since in this case asymmetrical forces act on the frame, which forces would, without the reinforcement element, severely influence the diaphragm and would worsen the measuring accuracy of the diaphragm. However, the reinforcement element can prevent this.

The reinforcement element can have a height in a range between 150 and 700 μm. The height of the reinforcement element should be adapted here to the height of the frame. The reinforcement element should be configured to have as large a height as possible in order to stabilize the frame over a large height without entering into direct contact with the diaphragm in this context. Correspondingly, a minimum distance between the diaphragm and the reinforcement element must remain free of the reinforcement element.

According to a further aspect, the present invention relates to an MEMS (micro-electromechanical system) microphone which has the transducer element described above.

In the text which follows, the transducer element and preferred exemplary embodiments will be explained in more detail with reference to the figures.

Figure 2:
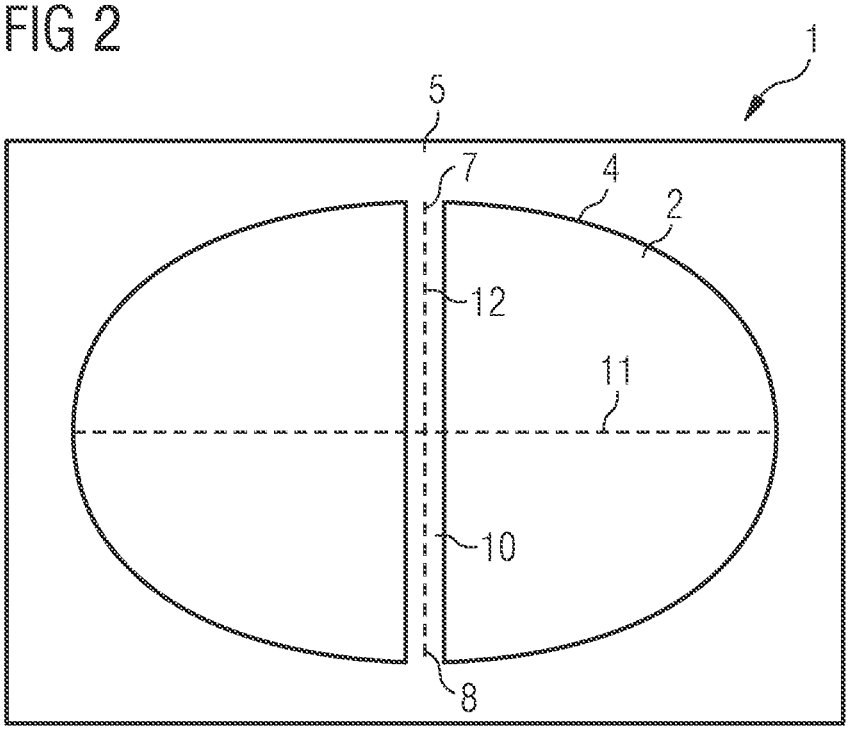
Figure 3:
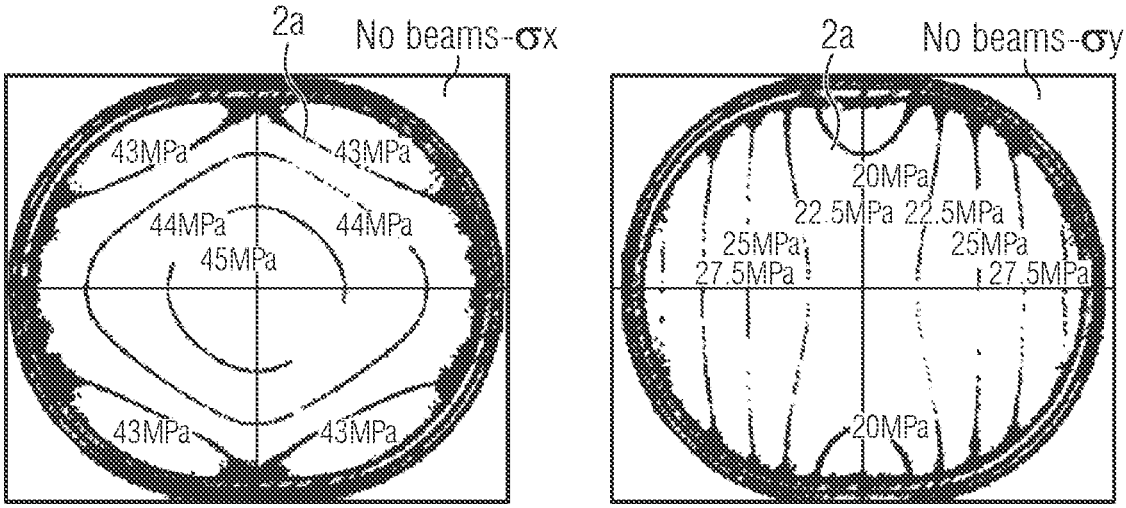
Figure 4:
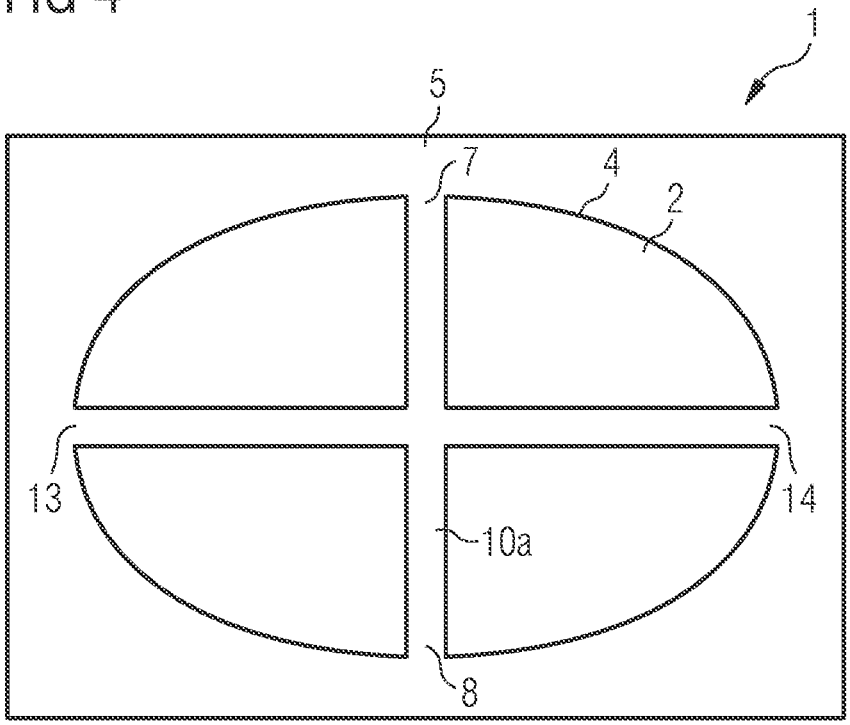
Figure 5:
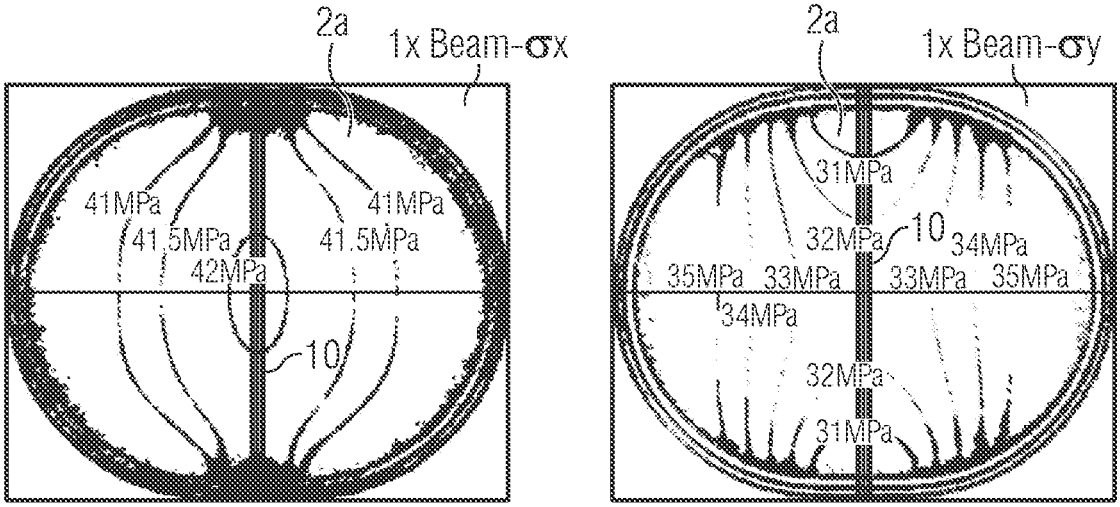
Figure 6:
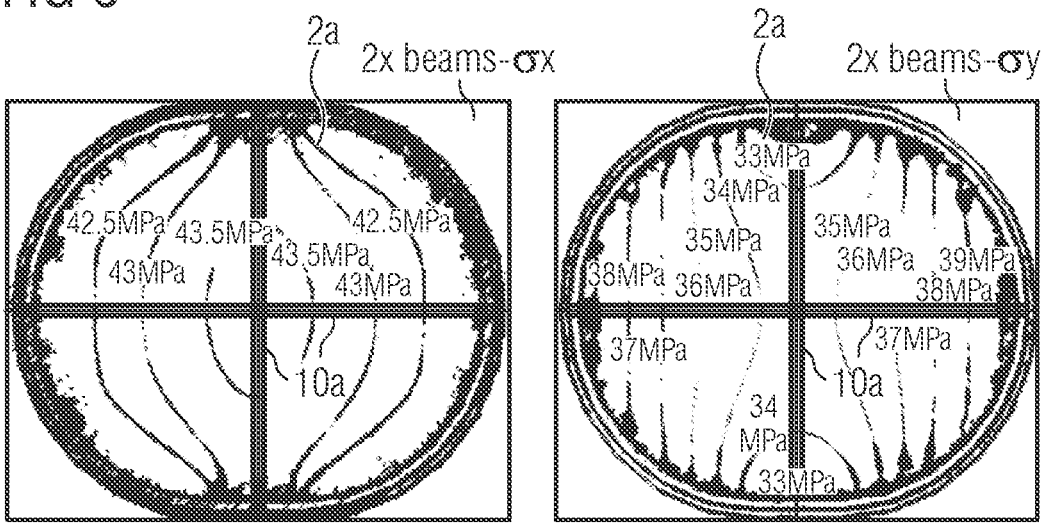
Figure 7:
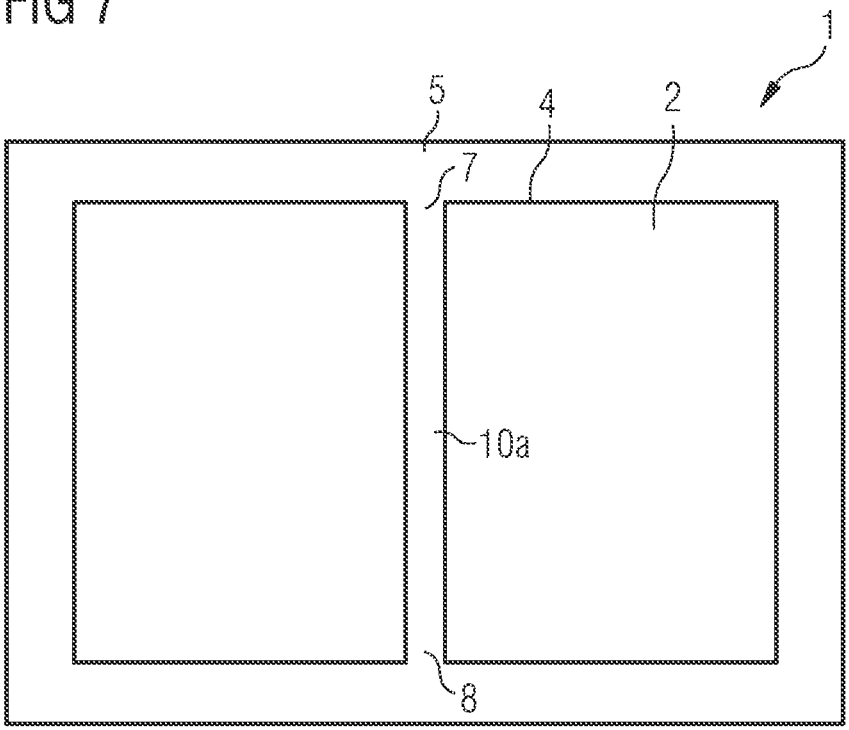
Figure 8:
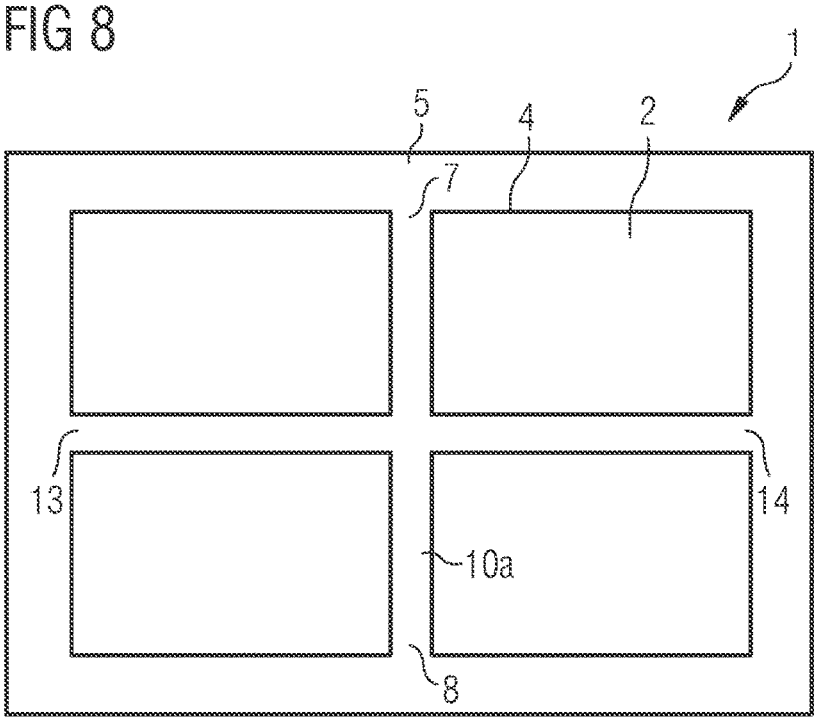
Figure 9:
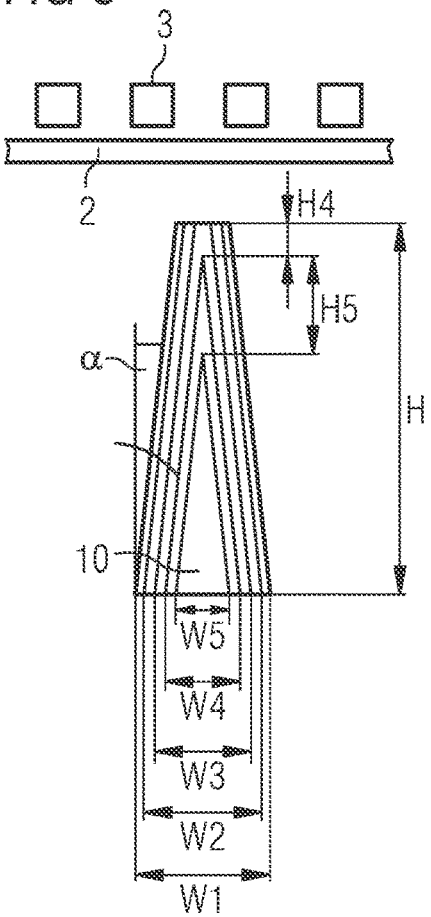

In the drawings:

FIG. 1 shows a cross section through a transducer element having a reinforcement element according to a first exemplary embodiment, FIG. 2 shows a cross section through the transducer element shown in FIG. 1, FIG. 3 shows a simulation of the mechanical stress which occurs in an oval diaphragm in a transducer element which does not have a reinforcement element, FIG. 4 shows a cross section through a transducer element having a reinforcement element according to a second exemplary embodiment, FIG. 5 shows a simulation of the mechanical stress which occurs in an oval diaphragm in a transducer element which has a reinforcement element according to the first exemplary embodiment, FIG. 6 shows a simulation of the mechanical stress which occurs in an oval diaphragm in a transducer element which has a reinforcement element according to the second exemplary embodiment, FIG. 7 shows a further exemplary embodiment of the transducer element having a reinforcement element according to the first exemplary embodiment, FIG. 8 shows a further exemplary embodiment of the transducer element having a reinforcement element according to the second exemplary embodiment, and FIG. 9 shows a detail of a transducer element.

FIG. 1 shows a cross section through a transducer element 1. The transducer element 1 has a movable diaphragm 2 and a fixed back plate 3. A voltage can be applied between the diaphragm 2 and the back plate 3, with the result that the diaphragm 2 and the back plate 3 form a capacitor. If the diaphragm 2 moves relative to the back plate 3 owing to a pressure fluctuation, the capacitance of this capacitor changes. In particular, sound waves can give rise to pressure fluctuations which change the capacitance of the capacitor. The transducer element 1 is configured to convert pressure fluctuations into an electrical signal. In particular, the transducer element 1 can convert an acoustic signal into an electrical signal.

The transducer element 1 forms a front volume and a rear volume. The front volume is suitable for communicating in terms of pressure with the surroundings of the transducer element 1. The transducer element 1 correspondingly has a sound inlet opening (not shown) via which the front volume can communicate in terms of pressure with the surroundings and via which sound waves or other pressure waves can travel to the diaphragm 2. The rear volume of the transducer element 1 is a reference volume which is acoustically isolated from the front volume. The transducer element 1 is suitable for measuring a time-variant difference between the sound pressure in the front volume and the pressure in the rear volume.

In addition, the transducer element 1 has a ventilation opening for static pressure equalization between the front volume and the rear volume. There is therefore no constant invariable pressure in the rear volume. Instead, the pressure in the rear volume is adapted slowly to an ambient pressure via the ventilation opening.

The ventilation opening has high acoustic impedance. Correspondingly, sound waves cannot penetrate the rear volume through the ventilation opening.

In addition, the movable diaphragm 2 has a border 4 which is attached to a frame 5 of the transducer element 1. The border 4 of the diaphragm 2 is attached in such a way that it cannot move in a direction toward the back plate 3 or away from the back plate 3. Just one internal region 6 of the diaphragm 2, which internal region 6 is not directly attached to the frame 5, is movable in the direction toward the back plate 3 and away from the back plate 3. The frame 5 of the transducer element 1 is composed of silicon.

FIG. 2 shows a cross section through the transducer element along the line AA' shown in FIG. 1.

The shape of the frame 5 is adapted to the shape of the diaphragm 2. The frame 5 can be divided into numerous sub-sections. In particular, the frame 5 has a first sub-section 7 and a second sub-section 8, wherein the first and the second sub-sections 7, 8 of the frame 5 lie opposite one another.

In addition, the transducer element 1 has a reinforcement element 10. The reinforcement element 10 connects the first sub-section 7 of the frame 5 to the second sub-section 8 of the frame 5. The reinforcement element 10 has a height which is somewhat less than the height of the frame 5. For example, the height of the reinforcement element 10 can be 5 to 25 μm less than the height of the frame 5. Correspondingly, the minimum distance 16 remains between the diaphragm 2 and the reinforcement element 10, with the result that the diaphragm 2 does not rest directly on the reinforcement element 10. The reinforcement element 10 extends from a lower edge 9 of the frame 5, which lower edge 9 is located on the side of the frame 5 lying opposite the diaphragm 2, as far as an upper limit 15 which is spaced apart from the diaphragm 2 by a minimum distance 16.

According to a first exemplary embodiment, the reinforcement element 10 is in the shape of a strip. The method of functioning of the reinforcement element becomes clearer from the cross section shown in FIG. 2.

The reinforcement element 10 connects the first sub-section 7 of the frame 5 and the second sub-section 8 of the frame 5. The reinforcement element 10 has the effect that smaller forces are applied to the diaphragm 2, and that, in particular, no asymmetrical forces act on the diaphragm 2, or at least the portion of the forces acting asymmetrically on the diaphragm 2 is reduced considerably.

Asymmetrically acting forces can arise, in particular, in the way described below: the fixed back plate 3 has a high stress. Correspondingly, the fixed back plate 3 applies to the frame 5 a force which contracts the frame 5 at its upper edge 17 at which the fixed back plate is arranged. At the same time, this force causes the frame 5 to be forced apart at its lower edge 9. As a result of the contraction of the frame 5 at the upper edge 17, the diaphragm 2, whose border 4 is attached to the upper edge 17 of the frame 5, also becomes warped. In the first exemplary embodiment shown in FIG. 2, the diaphragm 2 is in the shape of an ellipse. The ellipse shape defines a main axis 11 and a secondary axis 12 which is at a right angle to the main axis 11 and is shorter than the main axis 11.

FIG. 3 shows a simulation of the mechanical stress which acts on an oval diaphragm 2*a* without reinforcement elements 10. The oval diaphragm 2*a* is very similar to the ellipse-shaped diaphragm 2 shown in FIG. 2. The left-hand illustration shows the mechanical stress acting in the x direction, and the right-hand illustration shows the mechanical stress acting in the y direction. In this context, the x direction is defined by the connecting line of the two points on the diaphragm 2*a* which are furthest away from one another, and the y direction is perpendicular to the x direction. In the case of the elliptical diaphragm 2, the main axis 11 extends in the x direction, and the secondary axis 12 extends in the y direction.

In FIG. 3 it is clearly apparent that a significantly higher mechanical stress occurs along the x direction of the diaphragm 2*a*. The average mechanical stress is 49.6 MPa along the x direction. The average mechanical stress is 38.7 MPa along the y direction. Overall, the difference between the average mechanical stresses in the x and y directions in the oval diaphragm 2*a* without a reinforcement element 10 is 10.9 MPa.

The reason for the non-uniform distribution of the mechanical stress in the x and y directions is that the frame 5 is weaker in the x direction, owing to the relatively large extent of the diaphragm 2, than in the y direction. Correspondingly, the diaphragm 2 becomes warped to a greater extent in the x direction than in the y direction under the force applied to the frame 5 by the fixed back plate 3.

The reinforcement element 10 ensures that the first and second sub-sections 7, 8 of the frame 5 are held at a fixed distance from one another. The frame 5 is therefore held fixedly from its lower edge 9 up to the height which corresponds to the minimum distance between the diaphragm 2 and the reinforcement element 10, in such a way that the sub-sections 7, 8 are at a fixed distance from one another here. This fixed distance is predefined by the length of the reinforcement element 10. This prevents the frame 5 from being able to move to a great extent at its upper edge. Therefore, fewer forces are applied to the diaphragm 2, 2*a*. As a result of the arrangement of the reinforcement element 10 at a mechanical weak point of the frame 5 as described here, in particular the asymmetrical portions of the force acting on the diaphragm 2, 2*a* can be reduced.

FIG. 4 shows a second exemplary embodiment of the reinforcement element 10*a*. Here, the reinforcement element 10*a* is configured in the shape of a cross. The reinforcement element 10*a* correspondingly connects not only the first and second sub-sections 7, 8 of the frame 5 but now also a third sub-section 13 of the frame 5 to a fourth sub-section 14 of the frame 5 which lies opposite the third sub-section 13. The third and fourth sub-sections 13, 14 are also held at a fixed distance from one another. In addition, the third and fourth sub-sections 13, 14 are now also held in a defined position relative to the first and second sub-sections 7, 8 by the reinforcement element 10*a*. The third and fourth sub-sections 13, 14 of the frame 5 also each extend from the lower edge 9 of the frame 5 up to the upper limit 15, with the result that the minimum distance 16 between the reinforcement element 10*a* and the diaphragm 2 remains free.

FIGS. 5 and 6 each show simulations of the mechanical forces which occur and which act on the oval diaphragm 2*a*, wherein a reinforcement element 10 in the shape of a strip according to the first exemplary embodiment is provided in FIG. 5, and a reinforcement element 10*a* in the shape of a cross according to the second exemplary embodiment is provided in FIG. 6. In FIG. 5 and FIG. 6, the mechanical stresses acting in the x direction are respectively illustrated in a left-hand illustration, and the mechanical stresses acting in the y direction are respectively illustrated in a right-hand illustration.

It is apparent that the mechanical stresses which occur and which act on the diaphragm 2*a* can be reduced significantly compared to an exemplary embodiment without a reinforcement element 10. In the embodiment shown in FIG. 5 with the reinforcement element 10 in the shape of a strip, the average mechanical stress along the x direction is 47.4 MPa. Along the y direction, the average mechanical stress is 42.4 MPa. Overall, the difference between the average mechanical stresses in the x and y directions in the oval diaphragm 2*a* with the reinforcement element 10 in the shape of a strip is 5.0 MPa.

In the embodiment shown in FIG. 6 with the reinforcement element 10*a* in the shape of a cross, the average mechanical stress along the x direction is 47.3 MPa. Along the y direction, the average mechanical stress is 42.2 MPa. Overall, the difference between the average mechanical stresses in the x and y directions in the oval diaphragm 2*a* with the reinforcement element 10*a* in the shape of a cross is 5.1 MPa.

Both the reinforcement element 10 in the shape of a strip and the reinforcement element 10*a* in the shape of a cross therefore bring about a significant reduction in the difference between the average mechanical stresses in the x and y directions from 10.9 MPa to 5.0 MPa, and 5.1 MPa, respectively. Accordingly, the reinforcement element 10 in the shape of a strip and the reinforcement element 10*a* in the shape of a cross ensure that the mechanical stress is distributed more uniformly in the diaphragm 2*a*. There is no significant improvement to be seen here between the first and second exemplary embodiments of the reinforcement element 10, 10*a*. This is attributable to the particular shape of the frame 5, which is significantly less stable in one direction than in the other direction. Along the x axis, the frame 5 has a virtually straight part which deforms comparatively easily. Along the y axis, the frame 5 is in the shape of a semicircle and is therefore comparatively difficult to deform. In the case of frames 5 or diaphragms 2 which are shaped in some other way, a configuration of the reinforcement element 10*a* in the shape of a cross can, in contrast, significantly increase the mechanical stability compared to a configuration in the shape of a strip.

FIG. 7 and FIG. 8 show further exemplary embodiments of the transducer element 1. In FIG. 7 and in FIG. 8, the diaphragm 2*b* is configured in each case as a rectangle. In FIG. 7, the reinforcement element 10 is in the shape of a strip, and in FIG. 8 the reinforcement element 10*a* is in the shape of a cross.

In addition, other shapes of the reinforcement element are also possible, for example it can be in the shape of a star. The selected shape of the reinforcement element should always be adapted to the shape of the diaphragm.

FIG. 9 shows a detail of the transducer element 1 on the basis of which the manufacturing method of the transducer element 1 is outlined.

The frame 5 and the reinforcement element 10 are manufactured in a common etching step in which a mask is applied to a silicon wafer, and part of the silicon wafer is subsequently etched away, with the result that the front volume of the transducer element 1 is formed. The frame 5 and the reinforcement element 10 are therefore fabricated photolithographically from the silicon wafer.

The reinforcement element 10 is therefore manufactured with the etching step which generates a cavity in a silicon block. This method is referred to as deep reactive ion etching (DRIE). Depending on the selection of the process parameters, it can give rise to a negative angle of inclination $\alpha$ at the side walls of the cavity, which angle is also found on the sides of the reinforcement element 10. The height H of the reinforcement element 10 is set by means of the etching angle $\alpha$ and the width W of the mask which is used.

Various configurations of the reinforcement element 10 are shown in FIG. 9. In the case of a width W1, W2 and W3, the reinforcement element 10 has in each case the height H. In the case of a width W4 or W5 of the reinforcement element 10, a height of H4 or H5 is produced.

Depending on the mask used and depending on the etching angle $\alpha$, the reinforcement element 10 can be in the shape of a wedge with a blunt tip or can taper in the direction towards the diaphragm 2. The method is set in such a way that the reinforcement element 10 is spaced apart from the diaphragm 2 by the minimum distance. The etching process can also be modified in such a way that the etching angle $\alpha$ can be changed in order to fabricate reinforcement elements 10 of different widths with the same height.

LIST OF REFERENCE NUMBERS

1 Transducer element
2, 2*a*, 2*b* Diaphragm
3 Back plate
4 Border of the diaphragm
5 Frame
6 Internal region of the diaphragm
7 First sub-section
8 Second sub-section
9 Lower edge of the frame
10, 10*a* Reinforcement element
11 Main axis
12 Secondary axis
13 Third sub-section
14 Fourth sub-section
15 Upper limit
16 Minimum distance
17 Upper edge of the frame

The invention claimed is:

1. A transducer element comprising
a movable diaphragm which has a border,
a frame to which the border of the diaphragm is attached, and
a reinforcement element which connects to one another a first sub-section of the frame and a second sub-section of the frame which lies opposite the first sub-section,
wherein the reinforcement element has a height corresponding to the height of the frame minus a minimum distance between the reinforcement element and the movable diaphragm, wherein the first sub-section of the frame and the second sub-section of the frame extend from a lower edge of the frame, which is arranged on a side pointing away from the diaphragm, as far as a height corresponding to the height of the frame minus a minimum distance between the reinforcement element and the diaphragm, such that the reinforcement element ensures that the first sub-section and the second sub-section of the frame are at the same distance from one another along the entire height of the reinforcement element.

2. The transducer element according to claim 1,
wherein the reinforcement element has a height which is less than a height of the frame.

3. The transducer element according to claim 1, wherein the reinforcement element and the frame are composed of the same material.

4. The transducer element according to claim 1, wherein the reinforcement element connects to one another a third sub-section of the frame and a fourth sub-section of the frame which lies opposite the third sub-section.

5. The transducer element according to claim 1, wherein the reinforcement element is in the shape of a strip.

6. The transducer element according to claim 1, wherein the reinforcement element is in the shape of a cross.

7. The transducer element according to claim 1, wherein the reinforcement element is in the shape of a star.

8. The transducer element according to claim 1, wherein the diaphragm is elliptical or rectangular.

9. The transducer element according to claim 1, wherein the reinforcement element has a height between 150 μm and 700 μm.

10. An MEMS microphone having a transducer element according to claim 1.

11. The transducer element according to claim 1, wherein the transducer element comprises a fixed back plate and wherein the reinforcement element is arranged on a side of the diaphragm opposite of the fixed back plate.

12. The transducer element according to claim 1, wherein the frame is composed of silicon.

13. The transducer element according to claim 2, wherein the reinforcement element connects to one another a third sub-section of the frame and a fourth sub-section of the frame which lies opposite the third sub-section.

14. The transducer element according to claim 3, wherein the reinforcement element connects to one another a third sub-section of the frame and a fourth sub-section of the frame which lies opposite the third sub-section.

15. The transducer element according to claim 14, wherein the reinforcement element and the frame are composed of the same material.

16. The transducer element according to claim 2, wherein the reinforcement element is in the shape of a strip or of a cross or of a star.

17. The transducer element according to claim 2, wherein the diaphragm is elliptical or rectangular.

18. The transducer element according to claim 2, wherein the reinforcement element has a height between 150 μm and 700 μm.

19. The transducer element according to claim 13, wherein the reinforcement element has a height between 150 μm and 700 μm.

* * * * *